US006752211B2

(12) United States Patent
Dewey et al.

(10) Patent No.: US 6,752,211 B2
(45) Date of Patent: Jun. 22, 2004

(54) METHOD AND APPARATUS FOR MULTILATERAL JUNCTION

(75) Inventors: Charles H. Dewey, Houston, TX (US); Glenn L. Allison, Spring, TX (US); Praful C. Desai, Kingwood, TX (US); Bruce H. McGarian, Stonehaven (GB)

(73) Assignee: Smith International, Inc., Houston, TX (US)

( * ) Notice: Subject to any disclaimer, the term of this patent is extended or adjusted under 35 U.S.C. 154(b) by 71 days.

(21) Appl. No.: 09/992,219

(22) Filed: Nov. 6, 2001

(65) Prior Publication Data

US 2002/0079102 A1 Jun. 27, 2002

Related U.S. Application Data

(60) Provisional application No. 60/247,295, filed on Nov. 10, 2000.

(51) Int. Cl.[7] ..... E21B 43/10
(52) U.S. Cl. ..... 166/313; 166/50; 166/117.6
(58) Field of Search ..... 166/313, 50, 117.5, 166/117.6

(56) References Cited

U.S. PATENT DOCUMENTS 6,047,774 A * 4/2000 Allen ..... 166/313
6,354,375 B1 * 3/2002 Dewey ..... 166/313
6,499,537 B1 * 12/2002 Dewey et al. ..... 166/50
6,568,469 B2 * 5/2003 Ohmer et al. ..... 166/50

FOREIGN PATENT DOCUMENTS

| | | | |
|---|---|---|---|
| GB | 2295840 A | 6/1996 | ..... E21B/43/30 |
| GB | 2304764 A | 3/1997 | ..... E21B/43/30 |
| GB | 2322147 A | 8/1998 | ..... E21B/43/30 |
| GB | 2 333788 A | 8/1999 | ..... E21B/43/10 |

OTHER PUBLICATIONS

UK Search Report for Appln. No. GB 0126876.2 dated Feb. 8, 2002; (2 p.).

* cited by examiner

*Primary Examiner*—David Bagnell
*Assistant Examiner*—Matthew J Smith
(74) *Attorney, Agent, or Firm*—Conley Rose, P.C.

(57) ABSTRACT

A junction for the intersection of a main borehole and a lateral borehole includes a main tubular having a main window with a ramp aligned with the main window and a lateral tubular adapted to be telescopingly received within the main tubular and having a lateral window. The main tubular and lateral tubular each have an orientation surface. The lateral tubular has a first position with one end partially disposed within the main tubular. The lateral tubular is telescoped into the main tubular with the end of the lateral tubular engaging the ramp which guides the end of the lateral tubular through the main window and into the lateral bore. The orientation surfaces engage to orient the lateral window with the main window and form a common opening between the tubulars.

37 Claims, 12 Drawing Sheets

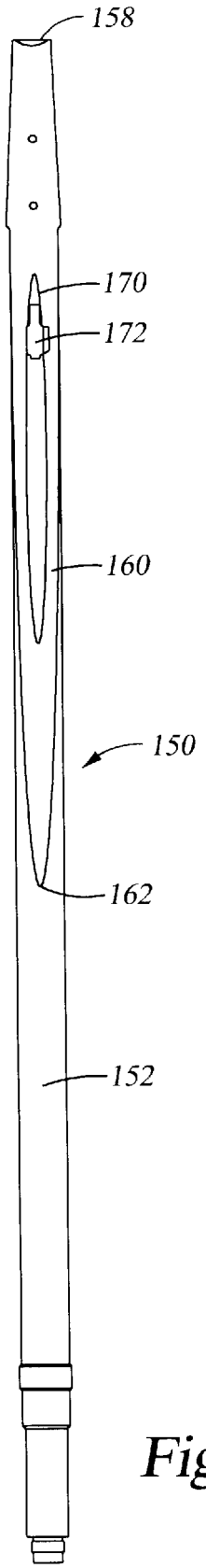
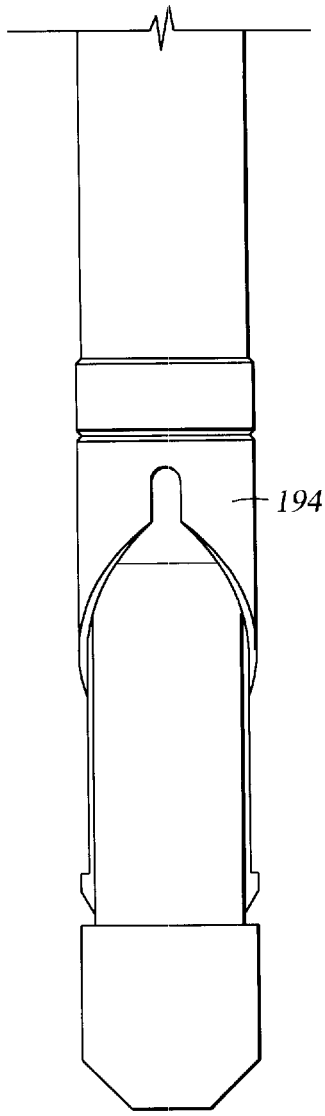
Fig. 11B
Fig. 11A
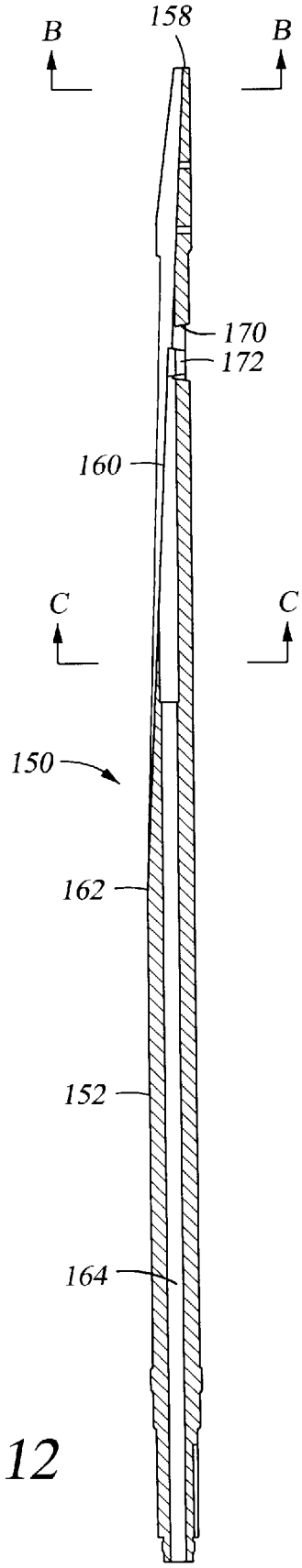
Fig. 12

METHOD AND APPARATUS FOR MULTILATERAL JUNCTION

CROSS-REFERENCE TO RELATED APPLICATIONS

This application claims the benefit of 35 U.S.C. 119(e) of U.S. provisional application Serial No. 60/247,295, filed Nov. 10, 2000 and entitled "Method And Apparatus For Multilateral Completions," hereby incorporated herein by reference, and relates to Great Britain Application No. U.K. 0112456.9 filed on May 22, 2001, and entitled "Downhole Lateral Completion System," hereby incorporated herein by reference.

STATEMENT REGARDING FEDERALLY SPONSORED RESEARCH OR DEVELOPMENT

Not applicable.

BACKGROUND OF THE INVENTION

1. Field of the Invention

The present invention relates generally to a method and apparatus for the completion of multilateral wells, that is, when one or more lateral wells are drilled from a primary well bore, and more particularly to a new and improved method and apparatus for a junction between the primary well bore and a lateral well bore.

2. Background of the Invention

Multiple lateral bores are typically drilled and extended from a primary or main well bore. The main well bore can be vertical, deviated, or horizontal. Multilateral technology can be applied to both new and existing wells, and provides operators several benefits and economic advantages over drilling entirely new wells from the surface. For example, multilateral technology can allow isolated pockets of hydrocarbons, which might otherwise be left in the ground, to be tapped. In addition, multilateral technology allows the improvement of reservoir production, increases the volume of recoverable reserves, and enhances the economics of marginal pay zones. By using multilateral technology, multiple reservoirs can be produced simultaneously, thus facilitating heavy oil production. Thin production intervals that might be uneconomical to produce alone become economical when produced together with multilateral technology. Consequently, it has become a common practice to drill deviated, and sometimes horizontal, lateral boreholes from a primary wellbore in order to increase production from a well.

In addition to production cost savings, development costs also decrease through the use of existing infrastructure, such as surface equipment and the well bore. Multilateral technology expands platform capabilities where space is limited, and allows more well bores to be added to produce a reservoir without requiring additional drilling and production space on the platform. In addition, by sidetracking depleted formations or completions, the life of existing wells can be extended. Finally, multilateral completions accommodate more wells with fewer footprints, making them ideal for environmentally sensitive or challenging areas.

The primary wellbore may be sidetracked to produce the lateral borehole into another production zone. Further, a lateral wellbore may be sidetracked into a common production zone. In sidetracking, a whipstock and mill assembly is used to create a window in the wall of the casing of a wellbore. The lateral wellbore is then drilled through this window out into the formation where new or additional production can be obtained.

One of the objectives of a multilateral well is containment of the surrounding formation. Production from a lateral borehole can be difficult if the lateral borehole is drilled through a loose or unconsolidated formation. If the lateral borehole is drilled through an unstable or unconsolidated formation, the formation will tend to cave into the borehole. The formation can also slough off, causing deleterious debris to mix with the production fluids. Thus, it is preferred to contain the formation to prevent cave-ins and slough-offs.

Formations that contain a significant amount of shale can be a particular problem. If the bore surfaces at and near the junction are not covered with a liner, chips and aggregate in this area tend to be drawn into the produced fluids and foul the production. Unfortunately, lining the bore surfaces near the junction can be complex and time consuming. Various devices have been proposed to provide a junction at the interface of the primary and lateral wellbores.

There have been attempts to use a perforated insert through the window to allow production from both the primary bore and lateral bore while reducing contamination from chips and aggregate. The perforations are aligned with the primary bore and fluid from the primary bore passes through the perforations. Unfortunately, the perforations tend to become clogged by the chips and aggregate and allow the chips and aggregate to contaminate the product, thereby reducing the effectiveness of this type of insert. Also, the use of a perforated insert hinders the ability to reenter the main bore below the junction.

The junction of the lateral borehole with the primary wellbore is usually ragged and rough as a result of the milling of the window through the casing to drill the lateral borehole. It is particularly difficult to seal around the window which is of a peculiar shape and has a jagged edge around its periphery.

A large area is exposed to the formations when the window is cut in the casing. A tie-back assembly may be disposed adjacent the junction of the lateral borehole and primary wellbore. See for example U.S. Pat. No. 5,680,901. The tieback assembly and liner limit the exposure of the formation through the window cut in the casing.

U.S. Pat. No. 5,875,847 discloses a multilateral sealing device comprising a casing tool having a lateral root premachined and plugged with cement. A profile receives a whipstock for the drilling of the lateral bore hole through the lateral root and cement plug. A lateral liner is then inserted and sealed within the lateral root.

TAML (Technology Advancement Multi-Lateral) defines six levels for a multi-lateral junction for a lateral borehole. For example, level three merely includes a junction with the main casing and a liner extending into the lateral borehole without cementing or sealing the junction. If the liner is merely cemented at the junction, it is a level four since cement is not acceptable as a seal. Level four simply includes cement around the junction. Level five requires pressure integrity at the junction.

Prior art multilateral wells are sealed with cement using a method well-known to those with skill in the art and described hereinafter.

Level five includes seals used to achieve pressure integrity around the junction. For example, in level five, separate tubulars extend through the main borehole and through the lateral borehole. A packer is placed around the upper ends of these tubulars to pack off with the casing of the cased main borehole. The lower end of the tubular extending through the main tubular includes a packer for sealing with the main tubular below the junction, and the lower end of the other tubular extending through the lateral borehole seals with an outer tubular in the lateral borehole below the junction. The lateral borehole preferably has been previously cased so that a seal can be set with that tubular extending into the lateral borehole. Since there are separate tubulars and both bores are now packed off, there can be independent production from each bore without commingling. The pair of tubulars above the junction may extend all the way to the surface, or one well may be produced through a production pipe extending to the surface and the other well may be produced through the annulus formed by the casing and the production pipe extending to the surface.

Where the formation pressure is substantially the same in the pay zones being produced by the main and lateral boreholes, the hydrocarbons from the main and lateral boreholes may be commingled. However, it is sometimes desirable to separate production so that each well can be independently controlled, such as where the pay zone pressures are different. In that case, separate tubulars are used to produce the individual wells, as previously described in a level five junction, or one well may be plugged off if necessary. Whether production is commingled or independent has no bearing on how a multilateral well is classified.

If the formation is a solid formation, the lateral borehole, for example, need not even include a casing or liner and may be produced open hole. If the lateral borehole is unconsolidated or unstable and would tend to cave in, the lateral borehole would be cased off or include a liner to contain the formation. For example, it is common in the prior art to run and set a liner in the lateral borehole with the liner extending from the flowbore of the casing and down into the lateral borehole. Cement is then pumped down through the cased main borehole, across the junction into the lateral borehole below the junction, and into the lateral borehole both inside and outside the liner. Then, the bore of the cased main borehole is cleaned out by drilling out the cement, including milling off that portion of the liner extending into the bore of the cased main borehole, leaving an exposed end of the liner at the junction which extends into the lateral borehole. The liner is then cleaned out giving access to both the main and lateral boreholes. This procedure is tedious and includes the problem of the drill tending to enter the liner as it removes the cement and liner end from the main borehole. This method is also problematic because the cement acts as both the junction and the seal. The cement is subject to failure due to limitations in the cement material itself or the ability to place the cement successfully at the junction. More particularly, under downhole conditions, cement can fail by deteriorating to such an extent that the seal begins to leak thus contaminating the production fluids.

An alternative to the above-described method is described in pending U.S. patent application Ser. No. 09/480,073, filed Jan. 10, 2000 and entitled "Lateral Well Tie-Back Methods and Apparatus." A lateral well tie-back apparatus and method is used to help ensure adequate flow and production from a lateral bore.

There are a variety of additional configurations that are possible when performing multilateral completions. For example, U.S. Pat. No. 4,807,704 discloses a system for completing multiple lateral wellbores using a dual packer and a deflective guide member. U.S. Pat. No. 2,797,893 discloses a method for completing lateral wells using a flexible liner and deflecting tool. U.S. Pat. No. 3,330,349 discloses a mandrel for guiding and completing multiple lateral wells. U.S. Pat. Nos. 4,396,075, 4,415,205, 4,444,276, and 4,573,541 all relate generally to methods and devices for multilateral completion using a template or tube guide head. For a more comprehensive list of patents, U.S. Pat. No. 6,012,526 details these configurations and presents a patent literature history of the well-recognized problem of multilateral wellbore completion.

Notwithstanding the above-described attempts at obtaining cost effective and workable lateral well completions, there continues to be a need for new and improved methods and devices for providing such completions, particularly sealing between the juncture of primary and lateral wells, the ability to re-enter lateral wells, particularly in multilateral systems, and achieving zone isolation between respective lateral wells in a multilateral well system. The present invention relates to a new and improved method and apparatus for the construction and completion of a multilateral well junctions, and overcomes the deficiencies of the prior art.

BRIEF SUMMARY OF THE INVENTION

A junction for the intersection of a main borehole and a lateral borehole includes a main tubular having a main window with a ramp aligned with the main window, and a lateral tubular adapted to be telescopingly received within the main tubular and having a lateral window. The main tubular and lateral tubular each have an orientation surface. The lateral tubular has a first position with one end partially disposed within the main tubular. The lateral tubular is telescoped into the main tubular with the end of the lateral tubular engaging the ramp which guides the end of the lateral tubular through the main window and into the lateral bore. The orientation surfaces engage to orient the lateral window with the main window and form a common opening between the tubulars. The ramp is preferably an arcuate surface at an angle to the axis of the main tubular and extends along the edges of the main window between the inner and outer diameters of the main tubular. The orientation surfaces are preferably mule shoe surfaces which engage to rotate the tubulars into alignment.

The junction may also include a shear member to releasably connect the lateral tubular within the main tubular until the junction is to be deployed. Once the lateral tubular is released, preferably by shearing the shear member, it telescopes down into the main tubular until the lateral tubular reaches the ramp adjacent the main window. The ramp deflects the lateral tubular out through the main window by engaging the end of the lateral tubular. The lateral tubular has one end extending from the main tubular to form the junction between the lateral borehole and the primary borehole. The main tubular extends into the main borehole and the lateral tubular extends into the lateral borehole.

The present invention is also directed to a method of multilateral well completions. To create a lateral well bore, a milling assembly is run into the main well bore to a desired depth and orientation. An anchor and/or packer are set. If a well reference member is not previously set, a reference member may also be set on the same run. A window is milled in the cased borehole and a lateral rat hole is drilled. The milling assembly and whipstock are then removed. The junction with main tubular and lateral tubular is run into the main bore in substantial alignment. The lateral tubular is partially disposed within the main tubular and is releasably held by a shear member. The main window becomes aligned with the lateral rat hole when an orienting member at the bottom of the main tubular engages the downhole well reference member, thereby rotating and orienting the junction assembly.

A weight is applied to the lateral tubular causing the lateral tubular to disengage the main tubular allowing the lateral tubular to be received within the main tubular. Any misalignment that occurs while the lateral tubular is deflected out of the main window via the ramp is corrected when the lateral orientation member engages the orientation surface of the main tubular. When the lateral orientation member and the main orientation surface are fully engaged, the lateral and main windows are substantially aligned and facing each other to form the junction.

There are many benefits to using the present invention. Critical work is done prior to exposing the time dependent formations. A level four multilateral well can be achieved without milling excess liner. A minimal amount of cementing is required, although cementing is optional for the present invention. The access diameters for both the main and lateral tubulars are maximized. The present invention allows re-entry capabilities in both bores.

Other objects and advantages of the invention will appear from the following description.

BRIEF DESCRIPTION OF THE DRAWINGS

For a detailed description of the preferred embodiments of the invention, reference will now be made to the accompanying drawings in which:

FIG. 11A is a front elevation view of a deflector for use with the junction of FIG. 1;

FIG. 11B is a front enlarged view of an orientation member coupled to the lower end of the deflector of FIG. 11A;

FIG. 12 is a side cross section view of the deflector of FIG. 11A;

NOTATION AND NOMENCLATURE

Figure 1:
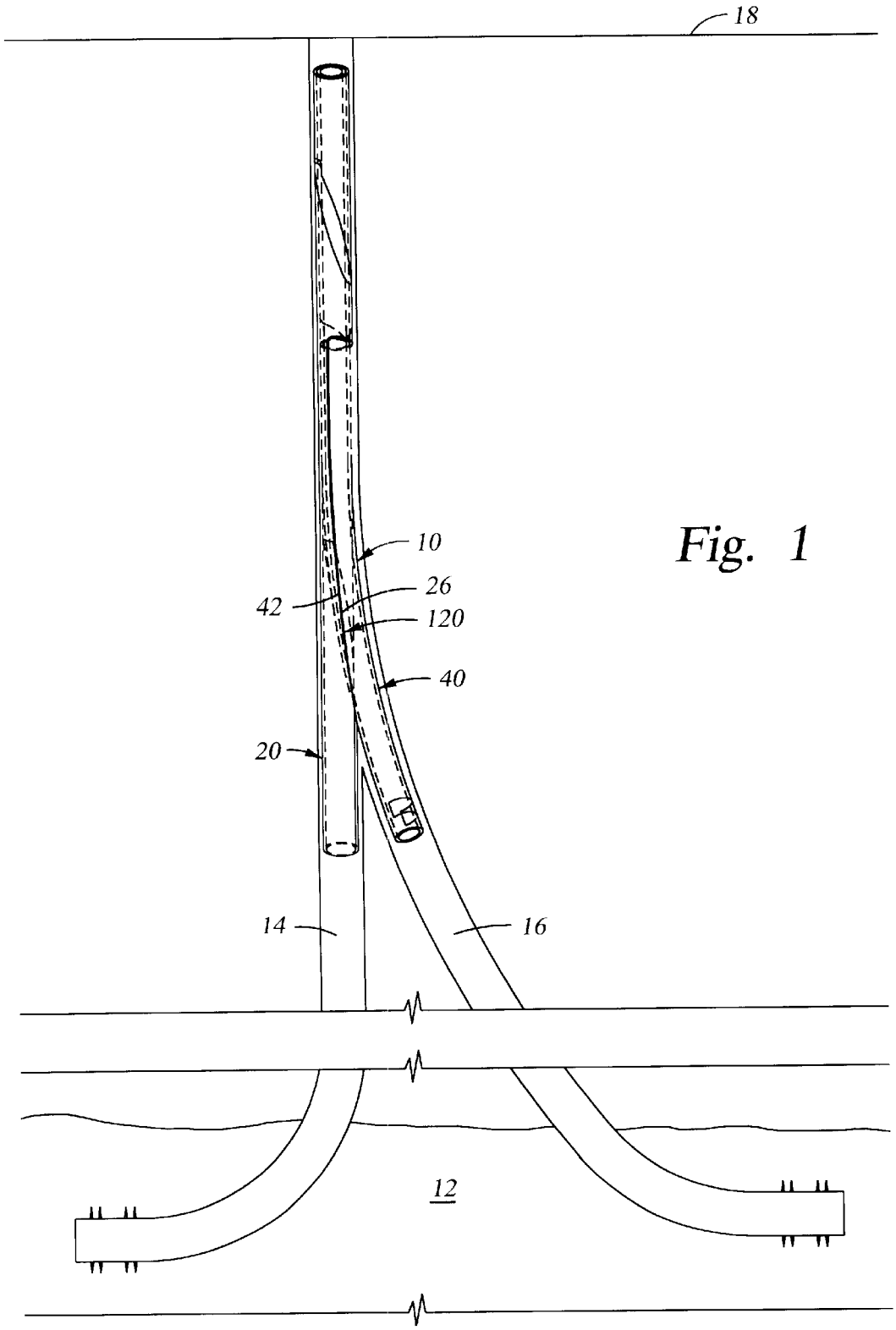
FIG. 1 is a schematic view of the deployed junction disposed within the main and lateral boreholes.
Figure 2:
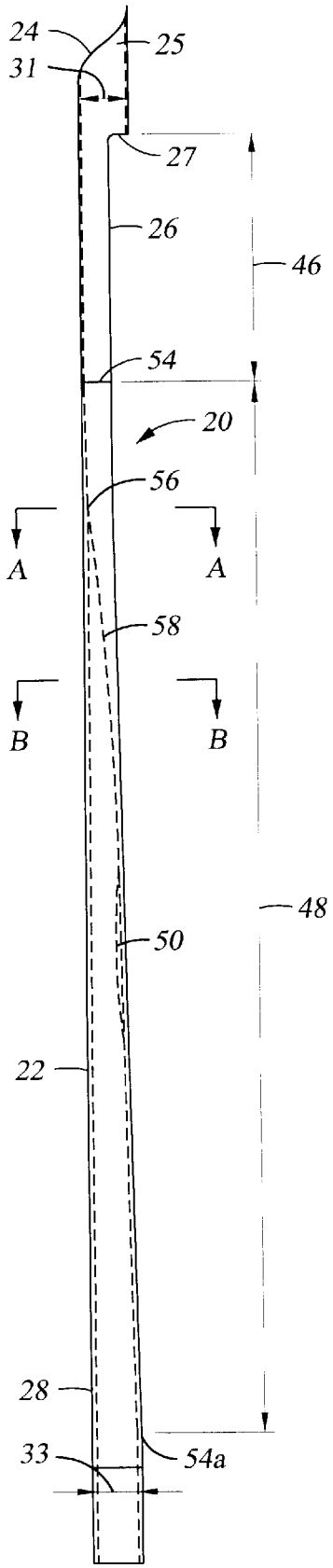
FIG. 2 is a side elevation view of the main tubular shown in FIG. 1.

Certain terms are used throughout the following description and claims to refer to particular system components. This document does not intend to distinguish between components that differ in name but not function. In the following discussion and in the claims, the terms "including" and "comprising" are used in an open-ended fashion, and thus should be interpreted to mean "including, but not limited to . . . ".

The present invention relates to methods and apparatus for providing a junction around a window cut in a casing and extending a liner into a lateral borehole. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

In particular, various embodiments of the present invention provide a number of different constructions and methods of operation. It is to be fully recognized that the different teachings of the embodiments discussed below may be employed separately or in any suitable combination to produce desired results. Reference to up or down will be made for purposes of description with "up" or "upper" meaning toward the surface of the well and "down" or "lower" meaning toward the bottom of the primary wellbore or lateral borehole.

DETAILED DESCRIPTION OF THE PREFERRED EMBODIMENTS

Referring initially to FIG. 1, a preferred embodiment of a junction 10 is shown deployed to produce hydrocarbons from a pay zone 12 through a primary borehole 14 and through a lateral borehole 16. Junction 10 includes a main tubular 20 and a lateral tubular 40 with the main tubular 20 extending into the primary borehole 14 and the lateral tubular 40 having its upper end disposed within an upper portion of the main tubular 20 and its lower end extending into the lateral borehole 16. Lateral tubular 40 includes a window 42 aligned with a window 26 in main tubular 20 in the deployed position whereby the production from pay zone 12 through primary and lateral boreholes 14, 16 may be commingled for flow to the surface 18.

Referring now to FIGS. 2–5, main tubular 20 includes a tubular body 22 having an upwardly facing orientation surface 24 and a main window 26 extending from an arcuate cut out 27 below orientation surface 24 to a full tubular portion 28 near the lower end of main tubular 20. The inside diameter 31 in the upper portion of tubular body 22 is larger than the inside diameter 33 in the lower portion of tubular body 22. The lower terminal end 30 of tubular body 22 includes a counterbore 32 forming a downwardly facing annular shoulder 34 for use with a deflector hereinafter described. It should be appreciated that the lower terminal end 30 may include a threaded connection for connecting a spline sub hereinafter described. Best shown in FIG. 4, orientation surface 24 includes a pair of main cam surfaces 36*a,b* forming a mule shoe extending from an apex 38 down into a recess or mule shoe slot 44.

Main window 26 includes a straight portion 46 and a ramp portion 48. Straight portion 46 is an arcuate cross-sectional cut out in tubular body 22 along the length of portion 46 having the enlarged inner diameter 31.

Figure 3:
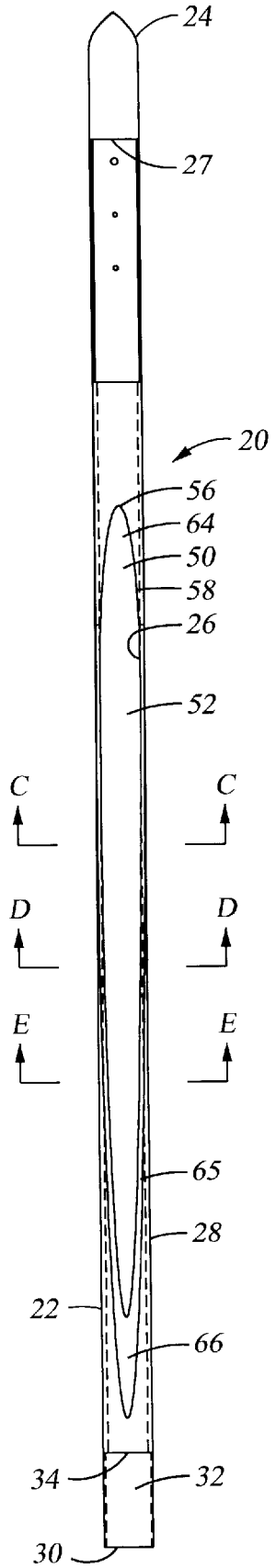
FIG. 3 is a front elevation view of the main tubular and main window of FIG. 2.
Figure 4:
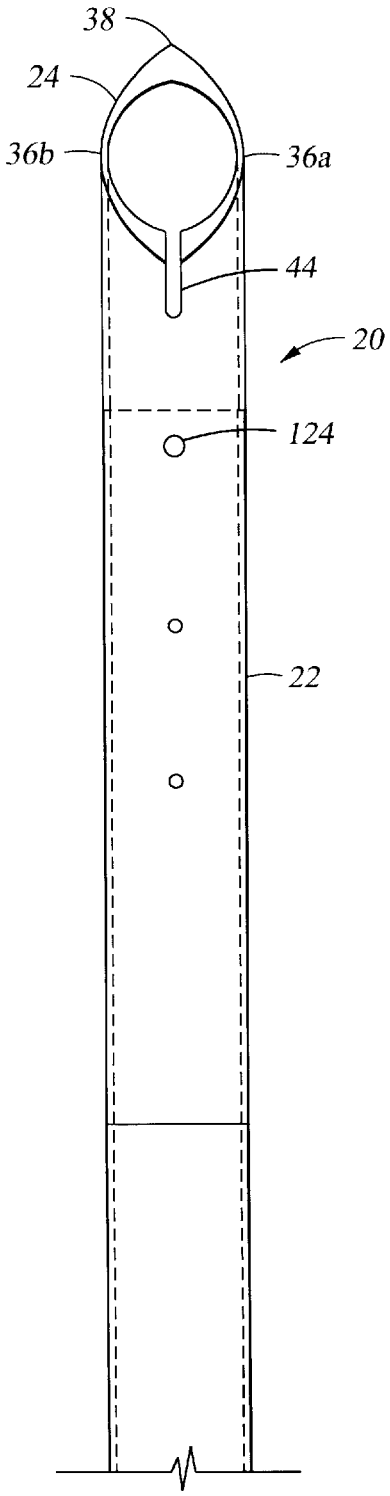
FIG. 4 is a back view of the top portion of the main tubular of FIG. 2.
Figure 5A:
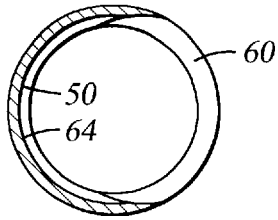
FIG. 5A is a cross section view of the main tubular taken along plane A—A of FIG. 2.
Figure 5B:
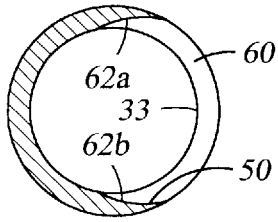
FIG. 5B is a cross section view of the main tubular taken along plane B—B of FIG. 2.
Figure 5C:
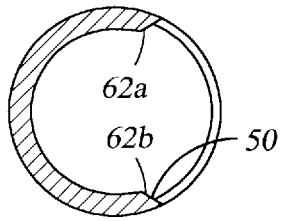
FIG. 5C is a cross section view of the main tubular taken along plane C—C of FIG. 3.
Figure 5D:
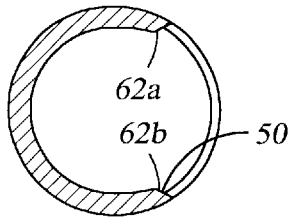
FIG. 5D is a cross section view of the main tubular taken along plane D—D of FIG. 3.
Figure 5E:
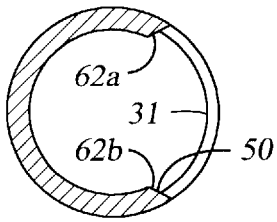
FIG. 5E is a cross section view of the main tubular taken along plane E—E of FIG. 3.

Referring still to FIGS. 2–5, the ramp surface 50 is initiated at point 54 by milling arcuate ramp portion 58 with the inside diameter 31 below the top of window 26 and continuing out the window 26 to point 54*a*. FIG. 5A is a cross section at point 56 of the arcuate ramp portion 58 where it begins to intersect reduced diameter 33. The mill has milled the arcuate portion 58 into the wall 60 of tubular body 22 and into the inner diameter of the wall 60 in the bottom face 64 of tubular body 22. FIG. 5B is a cross section showing the arcuate rails 62*a,b* milled into the wall 60 of tubular body 22 with the inner diameter of wall 60 achieving reduced diameter 33. FIGS. 5C, D, E illustrate the arcuate rails 62*a,b* milled into wall 60 in tubular body 22 along the lower portions of ramp 50. As best shown in FIG. 3, the lower end of ramp 50 is an arcuate milling at 66 in the outer surface of tubular body 22.

Ramp portion 48 is formed using a mill to cut a ramp surface 50 in a method similar to that used in milling a whip face on a whipstock. The radius is cut on a taper like a whip face. It is not cut coaxially with tubular body 22 but at an angle to the axis 52 of tubular 22. In cutting the ramp surface 50, the mill mills the tubular body 22 as though it were a solid piece of metal such as in a whipstock. Thus instead of milling an arcuate surface into a solid member, the arcuate surface is milled into a tubular member. The taper of the ramp 50 may be between 1½ and 3° and is preferably 3°.

Figure 6:
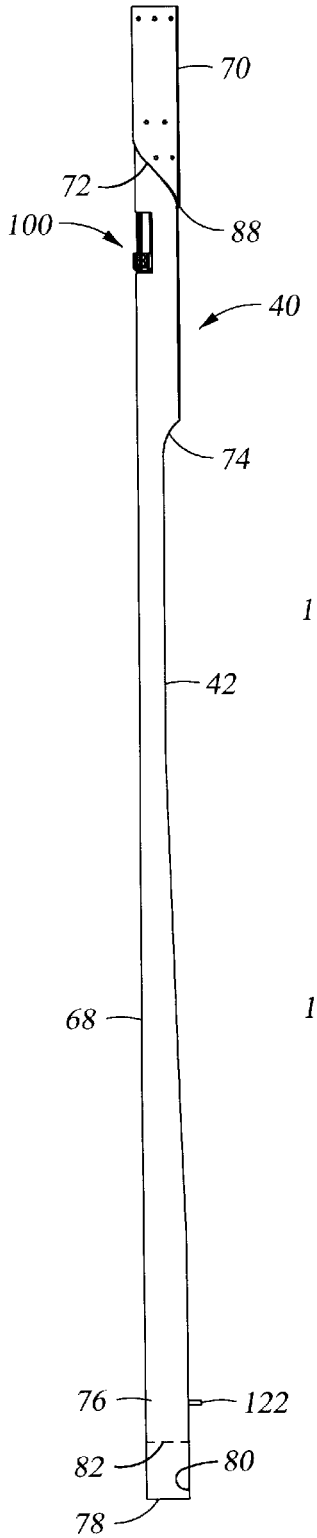
FIG. 6 is a side elevation view of the lateral tubular shown in FIG. 1.
Figure 7:
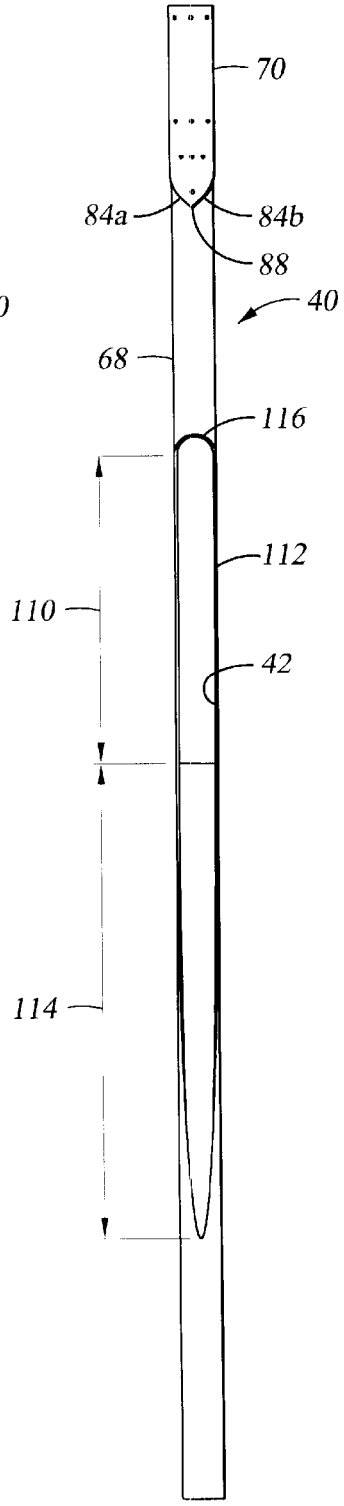
FIG. 7 is a front elevation view of the lateral tubular and lateral window of FIG. 6.
Figure 8:
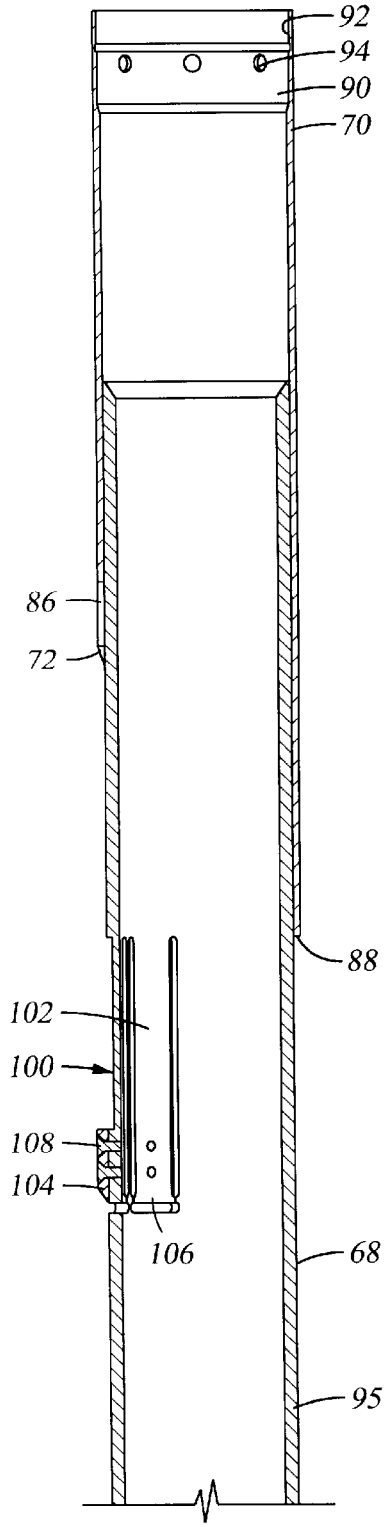
FIG. 8 is an enlarged cross section view of the upper portion of the lateral tubular of FIG. 6.

Referring now to FIGS. 6–8, lateral tubular 40 includes a tubular body 68 having an orientation member 70, with a downwardly facing orientation surface 72, affixed, such as by welding, to the top of lateral tubular body 68, and a main window 42 extending from an arcuate cut out 74 below orientation surface 72 to a full tubular portion 76 near the lower end 78 of lateral tubular 40. The lower end 78 of tubular body 68 may include a counterbore 80 forming a downwardly facing annular shoulder 82, as seen in FIG. 6. The inner and outer diameters of lateral tubular body 68 are preferably uniform along its length.

Orientation member 70 is a tubular member which is received over the upper end of lateral tubular body 68 and then preferably welded in place. Downwardly facing orientation surface 72 includes a pair of lateral cam surfaces 84*a,b* forming a mule shoe extending from a recess or mule shoe slot 86 down to an apex 88. Orientation member 70 is preferably disposed on a separate member for ease of manufacture of the downwardly facing orientation surface 72. Further, orientation member 70 is a separate member to provide a connection 90 for a running tool. Connection 90 includes a counterbore 92 having a plurality of holes 94 which engage latching members on the running tool. Connector 100 includes a plurality of fingers 102 cut into the wall 95 of lateral tubular body 68. Fingers 102 have latch pads 104 attached to the free end 106 of fingers 102, such as by screws 108.

Lateral window 42 is a precut window cut into lateral tubular body 68. There is no radius cut for the window 42 in lateral tubular 40. The upper portion 110 of window 42 has straight sides 112 and the lower portion of window 42 forms a hyperbolic portion 114. When lateral window 42 is aligned with main window 26, the upper terminal end 116 of lateral window 42 is approximately adjacent point 54 on ramp 50 in main window 26 and hyperbolic portion 114 is aligned with the lower hyperbolic portion 65 of main window 26. When in such alignment, facing windows 26, 42 form a common opening 120, best shown in FIG. 1, between main tubular 20 and lateral tubular 40 for the commingling of flow through the main tubular 20 from the primary borehole 14 and through lateral tubular 40 from the lateral borehole 16. Windows 26, 42 serve to provide full exposure of communication between main and lateral tubulars 20, 40.

The outer diameter of lateral tubular 40 is substantially the same as the enlarged inner diameter 31 of main tubular 20 at the top of main tubular 20 to point 54, below the top of window 26, at which point the inner diameter 31 begins to decrease as previously described. Only a small sliding clearance of about 0.060 of an inch is provided between main tubular 20 and lateral tubular 40 above point 54.

In the assembled but not yet deployed position, the lower end 78 of lateral tubular 40 is inserted into the upper end 25 of main tubular 20 and main and lateral tubulars 20, 40 oriented such that mule shoe point 38 on main tubular 20 is aligned with slot 86 on lateral tubular 40. Likewise, apex 88 on lateral tubular 40 will be aligned with slot 44 on main tubular 20. Since apex 88 is aligned with the centerline of lateral tubular window 42 and mule shoe point 38 is aligned with the centerline of main tubular window 26, in this position, orientation surfaces 24, 72 are now oriented such that windows 26, 42 face each other.

Upon insertion and alignment, a shear pin 122 in the lower end of lateral tubular 40 is inserted into an aperture 124 in the upper end of main tubular 20 thereby attaching main and lateral tubulars 20, 40 together for lowering into the primary borehole 14 from the surface 18. Preferably, the shear pin 122 is rated at 35,000 pounds. Shear screw 122 prevents premature setting of lateral tubular 40 within main tubular 20 should main tubular 20 encounter drag in the casing or become hung up in the casing. The shear screw 122 also permits pushing the main tubular 20 on the lower end of lateral tubular 40 through the borehole, particularly a horizontal borehole.

In another embodiment, the lateral tubular 40 may include a connector like that of connector 100 to attach lateral tubular 40 to a recess in the upper end of main tubular 20 such as at 27. In the preferred embodiment, should the shear pin 122 break prematurely, the connector will maintain the main tubular 20 disposed on the lower end of lateral tubular 40.

In operation, the junction 10 is deployed by disposing the main tubular 20 on the lower end of lateral tubular 40 using shear pin 122. A running tool on the lower end of a work string is releasably attached to the upper end of lateral tubular 40 by connection 90. This assembly is lowered into the primary borehole 14 until the assembly engages a well reference member, hereinafter described, which prevents the further downward movement of the main tubular 20 within the primary borehole 14. Weight is placed on the assembly causing shear pin 122 to shear disconnecting lateral tubular 40 from main tubular 20 and allowing the lateral tubular 40 to slide down into main tubular 20.

As the lower terminal end 78 of lateral tubular 40 moves through the top of main tubular 20, end 78 engages the beginning of ramp 50. End 78 first rides up the ramp 50 beginning at point 54 and cams lateral tubular 40 outward through main window 26. At about point 56 end 78 begins to ride the rails 62*a,b* which are initially in the interior walls 60 of main tubular 20. Arcuate surfaces milled into main window 26 of main tubular 20 form a ramp profile along the edges of window 26. This profile or ramp on the inner sides of main tubular 20 are cut into the wall 60 of main tubular 20, thereby reducing its equivalent diameter as shown in FIGS. 2 and 5A–E. As best shown in FIG. 5, the opposing arcuate rails 62*a,b* formed by the edges of open main window 26 then engage and guide the lower end 78 of lateral tubular 40 out through window 26.

Summarizing, the lower end 78 engages ramp 50, initially being guided by a ramp from points 54 to 56, then the rails 62*a,b* in the inner diameter of the walls 60 of main tubular 20 and then finally rides up rails 62*a,b* along the edges of window 26 and out through the lower end of window 26. Thus the ramp 50 deflects the lower end 78 of lateral tubular 40 outwardly through main window 26. It should be appreciated that the lateral tubular 40 may have any predetermined length as required for the lateral borehole 16.

Referring again to FIG. 1, near the end of travel of the lateral tubular 40 through main tubular 20, apex 88 will engage orientation surfaces 36*a,b* and mule shoe point 38 will engage the orientation surfaces 84*a,b*. As apex 88 and mule shoe point 38 ride along these orientation surfaces 36, 84, the lateral tubular 40 will rotate into proper orientation with main tubular 20 thereby aligning lateral window 42 with main window 26. Recess 44 shown in FIG. 4 receives apex 88 and recess 86 receives mule shoe point 38. Recesses 44, 86 avoid the additional expense of completing the contour of orientation surfaces 36, 84.

As illustrated in FIG. 1, in the preferred embodiment, in the deployed position, the lateral tubular 40 forms a Y junction with main tubular 20. Connector 100 connects lateral tubular 40 with main tubular 20 by engaging end 27 on main tubular 20.

In an alternative embodiment, the inner diameter 31 of tubular body 22 above and along the junction may be sized to receive two conduits that may be sealed off inside the main tubular 20, such as when the production fluids from the primary borehole 14 and the lateral borehole 16 are from different pay zones. The two conduits extend through the upper portion of main tubular 20 with one conduit then extending through main tubular 20 and the other independent conduit extending through lateral tubular 40. Additional clearance may be obtained through main tubular in reduced diameter 33 by increasing the inner diameter along the ramp 50 where the inner diameter is smaller. This can be achieved by scaling back the inner diameter portions between opposing arcuate rails 62*a,b*. Thus rails 62*a,b* remain intact while the portion of main tubular 20 remaining after milling window 26 can be reduced to enlarge inner diameters.

Figure 9:
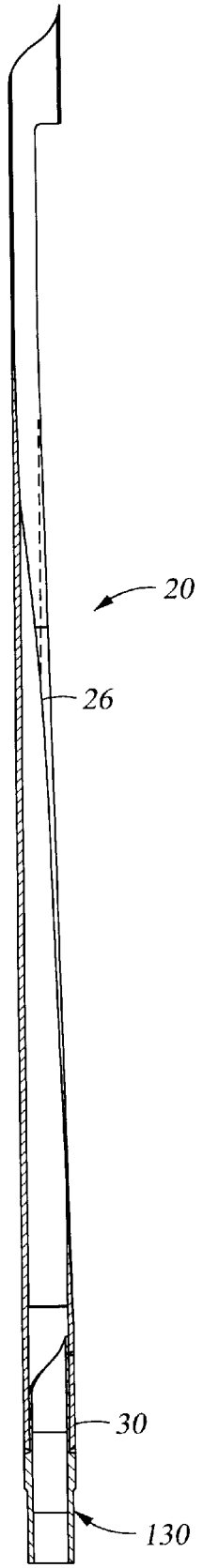
FIG. 9 is a side elevation view of the main tubular of FIG. 2 with an orientation member disposed therein.
Figure 10:
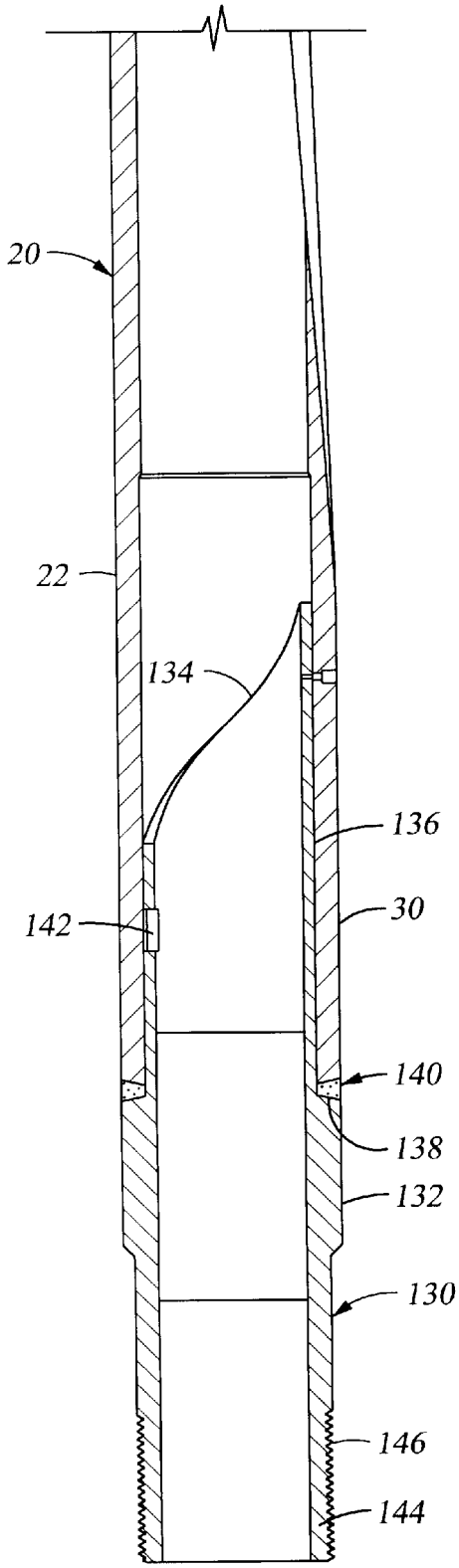
FIG. 10 is an enlarged view of the orientation member of FIG. 9.

Referring now to FIGS. 9 and 10, another preferred embodiment of the present invention includes an orientation member 130 disposed in the lower end 30 of main tubular 20. The orientation member 130 includes a tubular body having a diameter 132 and an upwardly facing orientation member or mule shoe 134 used to orient subsequent tools lowered through the primary borehole 14 below the junction with lateral borehole 16. The mule shoe 134 has a reduced outer diameter 136 forming an upwardly facing annular shoulder 138 which engages the lower terminal end 30 of main tubular 20. Upon orienting the mule shoe 134 with the window 26 and orientation surface 24, orientation member 130 is welded to the lower end of main tubular 20 at 140. The reduced outer diameter portion 136 includes a window or recess 142 for receiving a latching engagement from a subsequently run tool to latch the tool in place within main tubular 20 and thus in orientation with lateral borehole 16. The lower end 144 may include threads 146 for threading engagement to a lower tool such as a spline sub. Another method includes threading an extension sub having a mule shoe into the lower end of main tubular 20 and then orienting the mule shoe with respect to the window 26.

Referring now to FIGS. 11–14, there is shown one tool, namely a deflector 150, which may be used with orientation member 130 in main tubular 20 for directing other tools through the lateral tubular 40. Deflector 150 is used after lateral tubular 40 is deployed within main tubular 20. For instance, it may become necessary to re-enter the lateral borehole for further well operations such as for drilling the lateral borehole 16. Deflector 150 includes a tubular body 152 having a lower connector or latch 154 with a plurality of collet finger slots 156 and a plurality of shear screw apertures 159, best shown in FIGS. 14D and 14E, adapted to engage the orientation member 130, and a ramp surface 160 extending from the upper terminal end 158 to a point 162 approximately at the mid portion of tubular body 152. Moreover, deflector 150 also includes an internal bore 164 which allows downhole access to the main borehole 20 below the deflector 150.

Figure 13A:
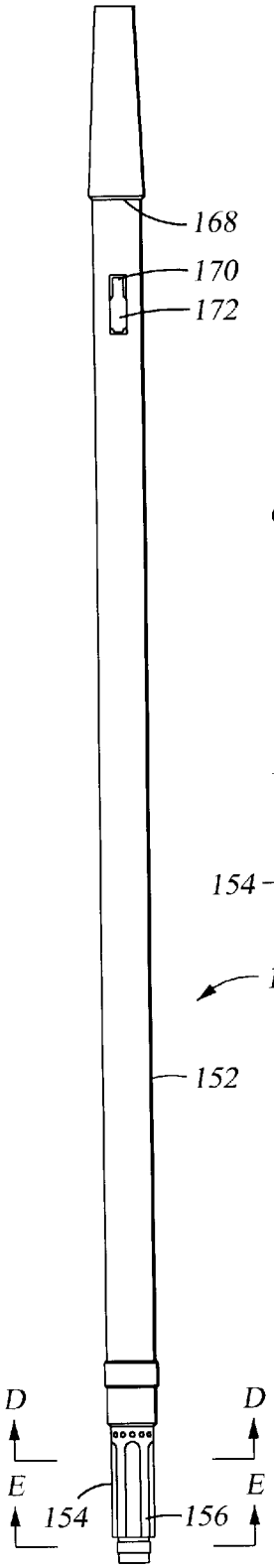
FIG. 13A is a back elevation view of the deflector of FIG. 11A.
Figure 13B:
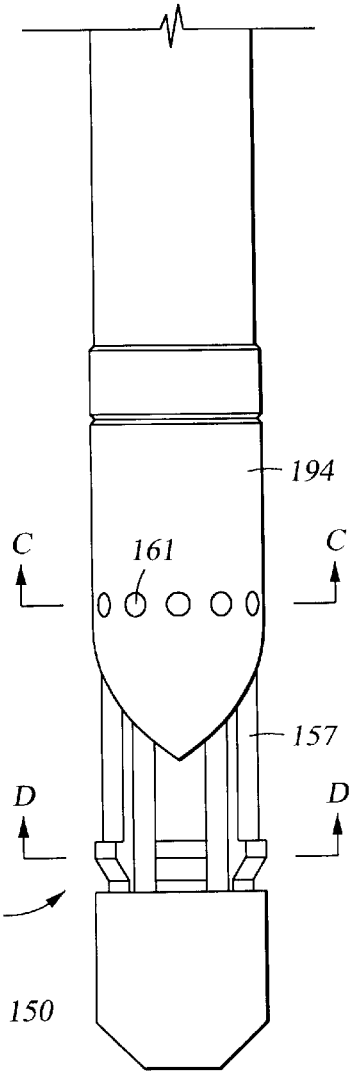
FIG. 13B is a back enlarged view of an orientation member coupled to the lower end of the deflector of FIG. 13A.
Figure 13C:
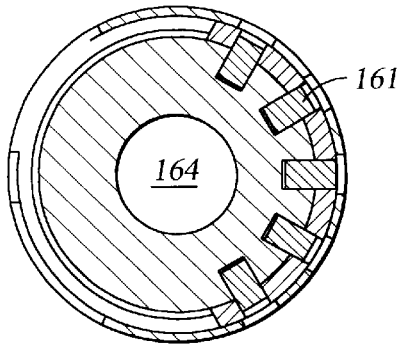
FIG. 13C is a cross section view of the orientation member and deflector taken along plane C—C of FIG. 13B.
Figure 13D:
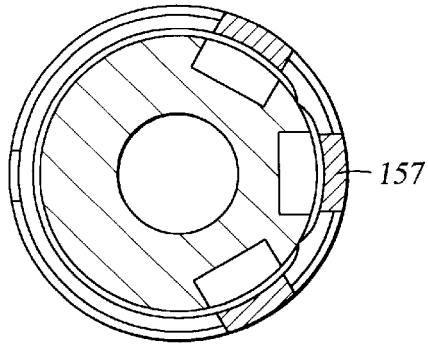
FIG. 13D is a cross section view of the orientation member and deflector taken along plane D—D of FIG. 13B.

Referring specifically to FIGS. 11B and 13B–D, it can be seen that deflector 150 has a key, such as mule shoe 194, which engages the mule shoe 134 of FIG. 10 to orient the deflector 150 with respect to windows 26 and 42. FIGS. 11B and 13B show the front and back views of the orientation member or mule shoe 194 which is coupled to the lower end of the deflector 150 of FIGS. 11A, 12, and 13A. Also shown are the collet fingers 157 of latch 154 which work in conjunction with collet slots 156 to engage orientation member 130. Shear screws 161 releasably attach collet fingers 157 and mule shoe 194 to the lower end of deflector 150. When it is necessary to retrieve deflector 150, the screws 161 may be sheared by an upward force exerted on deflector 150, thereby separating deflector 150 from both mule shoe 194 and collet fingers 157.

A recess 170 is provided through the upper end of ramp surface 160 for connection to a retrieving tool to retrieve deflector 150. Recess 170 includes a retrievable hook slot 172 which is used as a standard method of retrieval for a deflector. Upon lifting the retrieving tool, the deflector 150 is also lifted from within main tubular 20.

Figure 14A:
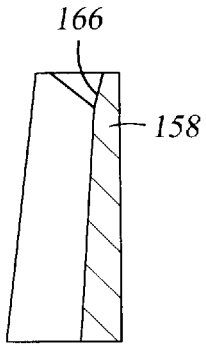
FIG. 14A is an enlarged view of the upper end of the deflector of FIG. 12.
Figure 14D:
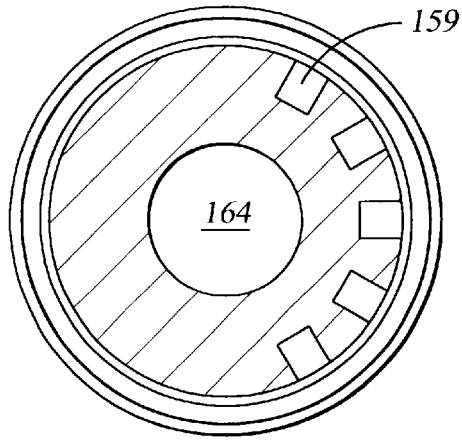
FIG. 14D is a cross section view of the deflector taken along plane D—D of FIG. 13A.
Figure 14B:
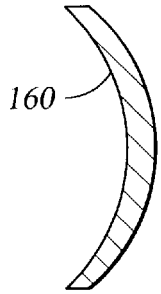
FIG. 14B is a cross section view of the deflector taken along plane B—B of FIG. 12.
Figure 14E:
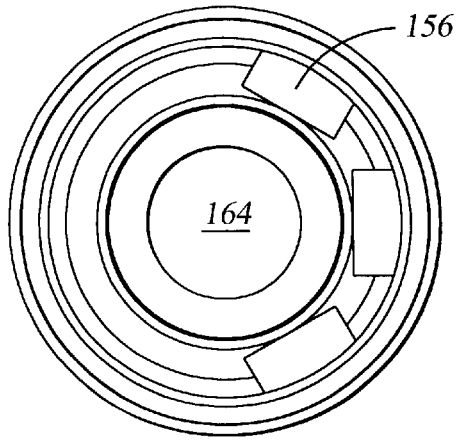
FIG. 14E is a cross section view of the deflector taken along plane E—E of FIG. 13A.
Figure 14C:
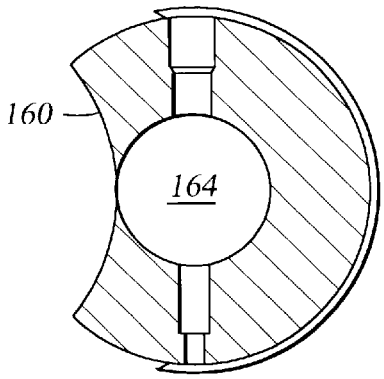
FIG. 14C is a cross section view of the deflector taken along plane C—C of FIG. 12.

Deflector ramp surface 160 begins at the initial cam surface 166 on upper terminal end 158, best shown in FIG. 14A. The ramp surface 160 extends past an upset 168 on tubular body 152 to mid point 162. See FIGS. 14B and 14C. Ramp surface 160 is formed similarly to ramp surface 50 of main tubular 20. Ramp surface 160 is spaced from orientation member 130 such that tools passing down the upper portion of main and lateral tubulars 20, 40 are directed by ramp 160 out through the lateral tubular 40 and into the lateral borehole 16.

In operation, the deflector 150 is lowered from the surface 18 down through the cased borehole and into the main tubular 20. A key, such as mule shoe 194 on the lower end of deflector 150, engages the mule shoe 134 on orientation member 130. The mule shoe 134 of orientation member 130 in main tubular 20 is used to land and orient deflector 150. As deflector 150 reaches slot 142, the collet connector 154 on the lower end of deflector 150 latches onto the orientation member 130.

In an alternative embodiment, a sealing assembly may be attached to the lower end of deflector 150 such that the sealing assembly seals or isolates primary borehole 14. A sealing assembly on deflector 150 is optional.

In another embodiment the deflector is eliminated and ramp 50 is used to deflect subsequent tools being passed through the junction. The main tubular bore size is reduced along the ramp 50 and below the junction. Machining a smaller bore in main tubular 20 causes the walls 60 to be wider. This will allow the ramp 50 in the bottom of main tubular 20 to serve both the purpose of deploying lateral tubular 40 and to serve the function of a deflector in deflecting tools out into the lateral borehole 16. However, it is necessary that the bore through the main tubular 20 be reduced.

Once junction 10 is in place, no tool can be run down through junction 10 which is larger than the inner diameter of the lateral tubular 40. In one size of the preferred embodiment, lateral tubular 40 has an inner diameter of about 6½ inches. Thus, a subsequent tool or other member which is 6½ inches in outside diameter could pass down through the main tubular 20 because it will clear the ramp. However, nothing requires that the bore through the main tubular 20 below the lateral tubular 40 be 6½ inches in inside diameter. It could be smaller, such as 6 inches. Thus, if a tool 6½ inches in diameter is run down hole, it could not pass through main tubular 20 at the junction. It would be deflected out into the lateral borehole.

Figure 15A:
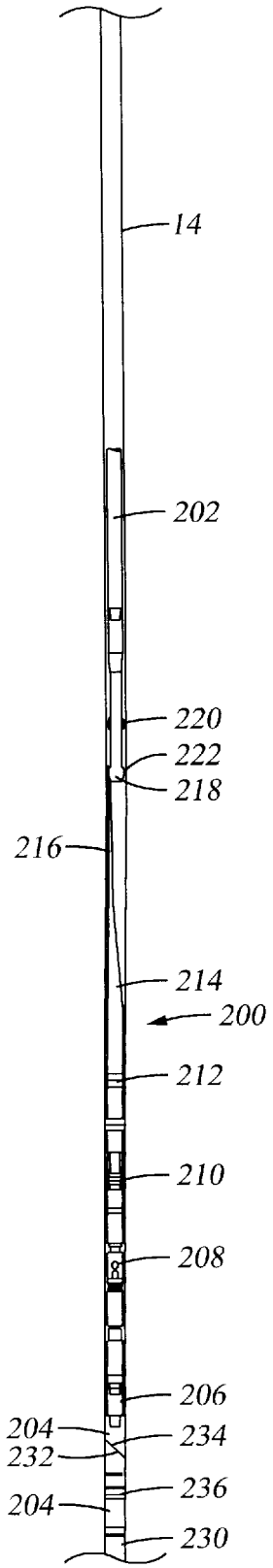
FIG. 15A is an elevation view of the whipstock assembly lowered into the primary borehole.

Referring now to FIGS. 15A–H, there is shown the sequential steps of a preferred method using the junction 10 of the present invention. Referring to FIG. 15A, a one trip milling assembly 200 is lowered into cased primary borehole 14 on a work string 202. The one trip milling assembly 200 includes a reentry tool 204, a spline sub 206, a retrievable anchor 208, a debris barrier 210, a production packer 212, a whipstock 214 having a ramp 216, and one or more mills 218, 220 releasably attached at 222 to the upper end of whipstock 214. The mills 218, 220 are disposed on the end of the work string 202 extending to the surface 18. The one trip milling assembly 200 is lowered onto a well reference member 230 which may be previously installed at a predetermined location in the cased primary borehole 14 for subsequent well operations, such as milling a window 240 in the casing 224 of primary borehole 14. Well reference member 230 may be termed an insert locator device (ILD) which replaces the typical big bore packer. Well reference member 230 is shown and described in pending U.S. PCT application Ser. No. PCT/US01/16442 filed May 18, 2001, hereby incorporated herein by reference.

Reentry tool 204 is mounted on spline sub 206 and includes a downwardly facing mule shoe 232 for engagement with upwardly facing mule shoe 234 on well reference member 230.

Well reference member 230 locates and orients the one trip milling assembly 200 above it. Well reference member 230 neither serves as an anchor member nor as a sealing member; it merely provides depth location and orientation for subsequent well operations over the life of the well. The anchoring and sealing functions are performed by other tools in the assembly 200 such as retrievable anchor 208 and production packer 212, which may be a weight set production packer. The assembly 200 is set down on the well reference member 230 and then weight is applied to the work string 202. The well reference member 230 orients the ramp 216 of whipstock 214 in the preferred direction of the window to be milled in the casing 224 shown in FIG. 15B. After anchor 208 is set, the work string 202 is pulled or pushed causing the lead mill 218 to shear connection 222 at the upper end of whipstock 214. Mills 218, 220 are then rotated and guided by whipstock ramp 216 into the casing 224 as work string 202 rotates the mills causing them to mill a window in casing 224.

Figure 15B:
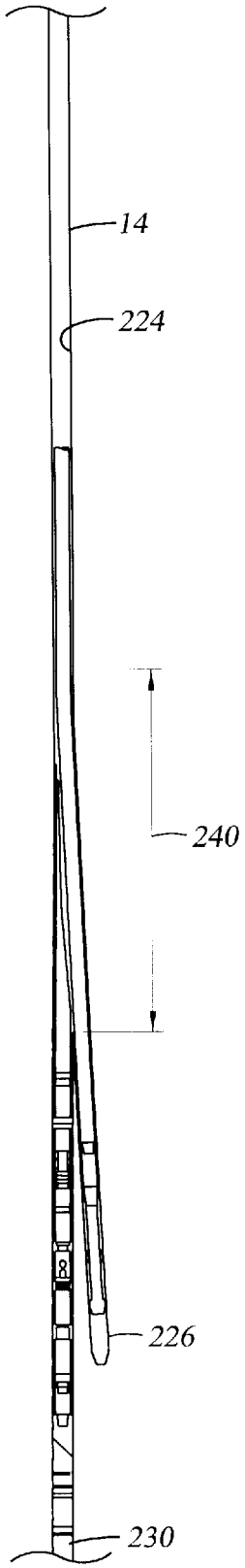
FIG. 15B is an elevation view of the mills forming a window and drilling a rat hole.

Referring now to FIG. 15B, mill 218 is shown milling through the main bore casing 224 to form a window 240. The window 240 is milled using conventional milling techniques. The use and configuration of these components in milling operations is well known by those skilled in the art. The work string 202 is rotated, thereby rotating mills 218, 220 as mills 218, 220 move downwardly and outwardly on ramp 216 of whipstock 214. Ramp 216 guides the rotating mills 218, 220 into engagement with the casing 224, thus cutting window 240 in casing 224. The mills 218, 220 continue to drill a rat hole 226, as the beginning of the lateral borehole 16, best shown in FIG. 15C.

Figure 15C:
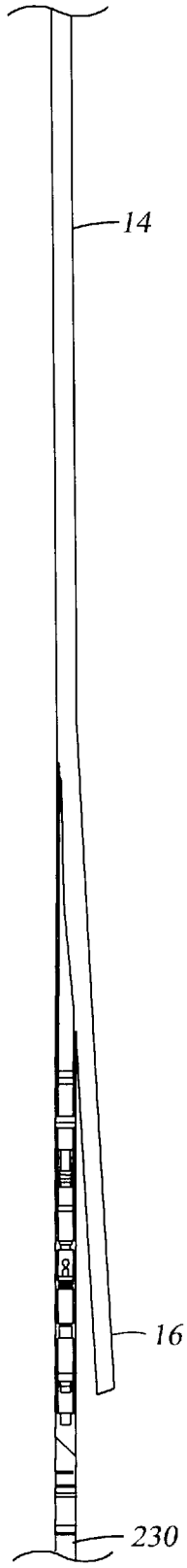
FIG. 15C is an elevation view of the mills having been retrieved and a drilling assembly having drilled a lateral borehole.

Referring now to FIG. 15C, once the rat hole 226 has been drilled using mills 218, 220, the work string 202 and mills 218, 220 are retrieved and removed from the cased primary borehole 14. A drill string (not shown) then is lowered into primary borehole 14 engaging the ramp surface 216 of whipstock 214 to enter rat hole 226 to drill the lateral borehole 16. Once the lateral borehole 16 has been completed, the drill string is removed from the cased borehole 14 and retrieved to the surface 18.

Figure 15D:
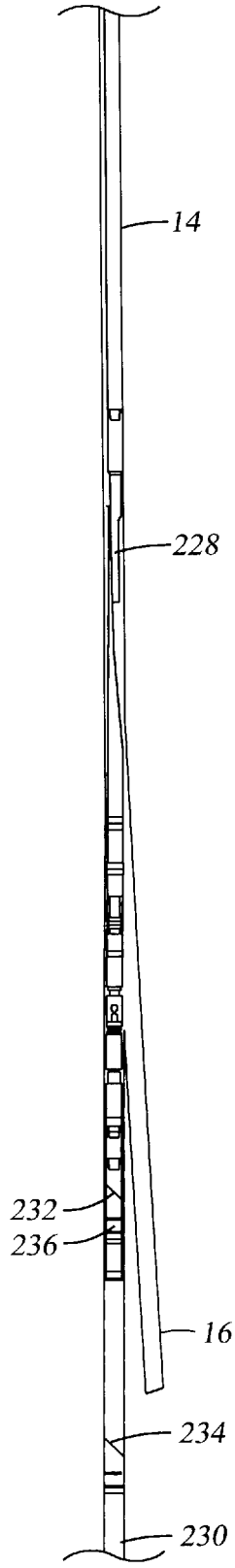
FIG. 15D is an elevation view of the whipstock assembly being retrieved from the borehole.

Referring now to FIG. 15D, upon completing the drilling of the lateral borehole 16, a whipstock retrieval tool 228 is lowered and connected to the upper end of whipstock 214. The retrievable anchor 208 is released from the cased borehole 14 and the whipstock assembly 200 is retrieved from the well. Everything but the well reference member 230 then has been removed from the main wellbore 14.

Figures 15E, 15F, 15G, 15H:
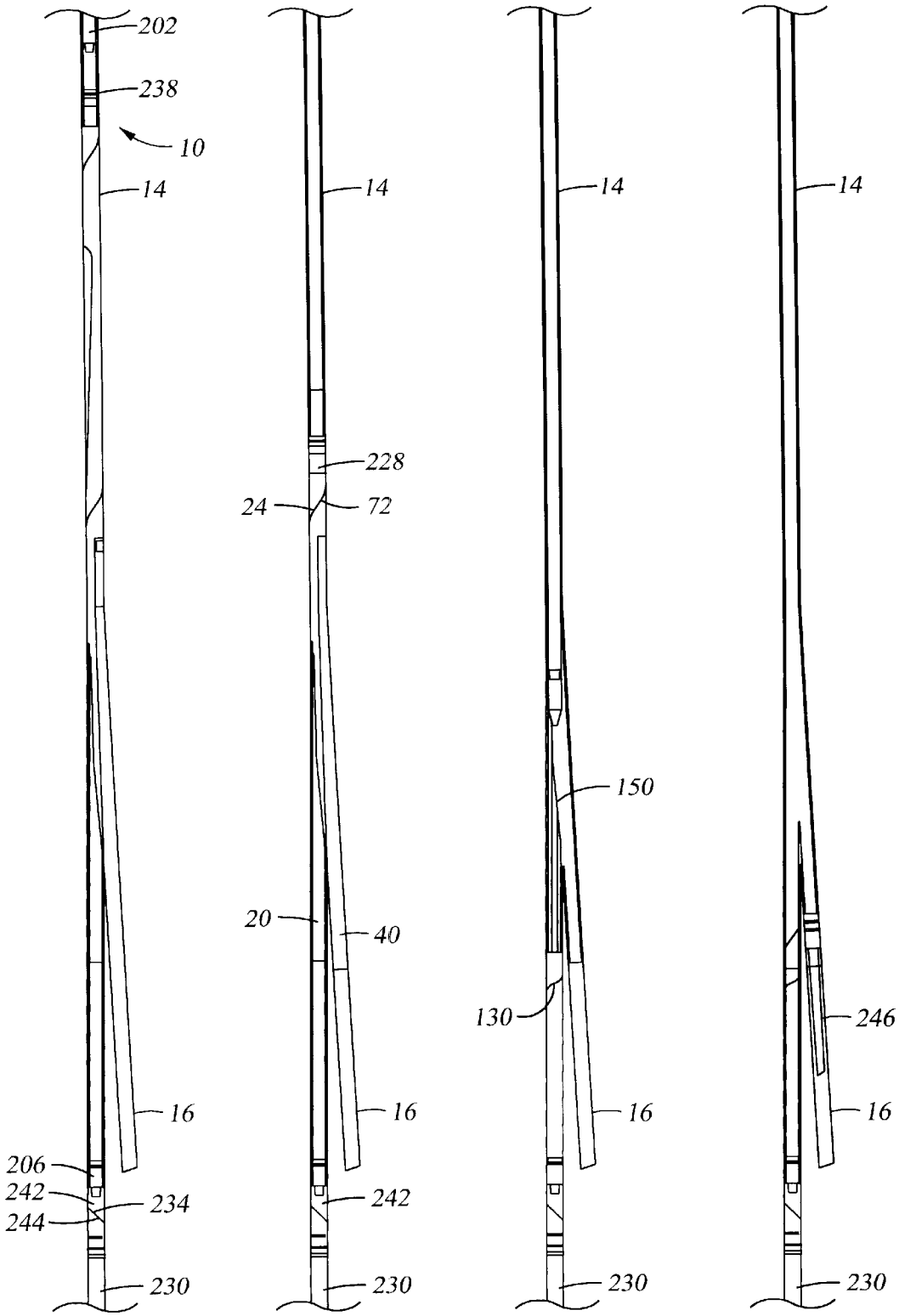
FIG. 15E is an elevation view with the main tubular and lateral tubular being lowered into the main borehole in the undeployed coaxial position.
FIG. 15F is an elevation view with the junction deploy ed at the intersection of the main borehole and lateral borehole.
FIG. 15G is an elevation view of a deflector disposed within the main tubular.
FIG. 15H is an elevation view a liner disposed through the lateral tubular and into the lateral borehole.

Referring now to FIG. 15E, the junction 10 is in a running configuration and is attached to a running tool 238 on the lower end of another work string 202 by releasably connecting running tool 238 to connection 90 on the upper end of lateral tubular 40. Running tool 238 attaches to the upper end of lateral tubular 40 just above orientation member 72. Shear screws fit into apertures 94 to attach running tool 238 to the upper end of lateral tubular 40.

The lower end of lateral tubular 40 is inserted into the upper end of main tubular 20 and attached by shear pin 122. A reentry orientation tool 242 is attached to the lower end 30 of the main tubular 20. The reentry orientation tool 242 includes a downwardly facing mule shoe 244 which engages the upwardly facing mule shoe 234 on well reference member 230 to cam the entire junction assembly of tubulars 20, 40 into the proper orientation with respect to the window 240 which has been milled into the casing of the cased borehole 14. In the preferred embodiment, the reentry orientation tool 242 may or may not latch onto the well reference member 230. A spline sub 206 is located just below main tubular 20 and is used to properly orient the mule shoe 244 of reentry tool 242 such that when the assembly is landed onto the well reference member 230, the junction assembly is properly oriented with respect to the window 240 in casing 224. The spline sub 206 allows the reentry orientation tool 242 to be realigned in 5° increments thus, providing 72 different positions.

Referring now to FIG. 15F, junction 10 is shown in the deployed position. After the junction 10 has been oriented with casing window 240, weight is applied to the junction assembly so as to shear the shear pin 122. Since main tubular 20 has landed and can no longer move further down into the main bore 14, the weight causes lateral tubular 40 to move downwardly within the main tubular 20 whereupon the lateral tubular engages the ramp 50 of main tubular 20. As lateral tubular 40 continues its downward movement, ramp 50 cams lateral tubular 40 out through main window 26 and into the lateral borehole 16. As the lateral tubular 40 moves through the main window 26, the downwardly facing lateral tubular mule shoe 72 engages the upwardly facing mule shoe 24 on main tubular 20 causing lateral tubular 40 to rotate into alignment with main tubular 20 whereby the windows 26, 42 are aligned forming a common window 120 and a Y junction between primary borehole 14 and lateral borehole 16.

Referring now to FIG. 15G, deflector 150 may be lowered into the main tubular 20 using a deflector running tool on a work string. The mule shoe 194 on the lower end of deflector 150 engages the upwardly facing mule shoe 134 on orientation member 130 to properly orient deflector 150 so that ramp surface 160 of deflector 150 faces the casing window 240 and lateral bore 16.

Referring now to FIG. 15H, having deployed junction 10, a liner 246 may be run through the lateral tubular 40 and into the lateral bore 16. The liner 246 may or may not be used in the present invention and is an alternative embodiment.

The junction 10 as shown in FIG. 15H is a level three because the junction 10 includes a first tubular 20 extending into the main borehole 14 and a second tubular 40 extending into the lateral borehole 16 without cementing or sealing the junction. A level four can be achieved by cementing in junction 10. To cement junction 10, packers or plugs are set in primary borehole 14 below main tubular 20 and then a flapper valve is set above the orientation member 130 to prevent cement from reaching upwardly facing mule shoe 134. A clean out tool is then run through the main tubular 20 to just above orientation member 130 to remove the cement in main tubular 20 and through the lateral tubular 40 to remove the cement in lateral tubular 40. Thus a level four junction has been achieved.

A level five may be achieved by running a pair of conduits into the junction 10 with each conduit having a packer or other sealing assembly on its lower end. A dual bore packer is attached to the upper ends of the conduits. One conduit is run into the main tubular 20 and its packer set to seal with the cased borehole below the main tubular 20 and the other conduit is run into the lateral tubular 40 and its packer is set below the lateral tubular 40 in the lateral borehole 16. The dual bore packer is set above the junction 10 in the cased primary borehole above the junction 10. The sealing engagements of the packers provides the required pressure integrity at the junction for a level five.

In another alternative embodiment of this invention, the main tubular 20 and lateral tubular 40 can be run separately into the well bore. This is typically necessary when the lateral tubular 40 includes a pipe string that is hundreds of feet long. Usually, the lateral 40 is run as one piece with the main tubular 20, but when it is so long that the lateral tubular 40 extends a great distance into the lateral borehole 16, it becomes impractical to run the assembly as one piece. In such an embodiment, the lateral tubular 40 can be run in separately after the main tubular 20 has landed onto the well reference member 230. After the main tubular 20 is run into the main bore 14, the main window 26 is aligned with the casing window 240. The lateral tubular 40 may subsequently be run through the main bore 14 and into the lateral bore 16, similarly achieving alignment between the main window 26 and lateral window 42.

Where a long pipe string is attached to the end of the main tubular 20, a retainer may be added to the lower end of lateral tubular 40 adjacent the shear pin 122 to carry the additional load of the main tubular 20 on the lateral tubular 40. Also if a liner is attached to the end of lateral tubular 40, a swivel may be used to attach the lateral tubular 40 with the liner to allow the liner to swivel freely as the liner is passing into the lateral borehole 16.

One advantage of the present invention is that a liner several hundred feet long can be disposed on the end of the lateral tubular 40 and run immediately after the borehole has been drilled. This provides support for any unconsolidated formation in the lateral borehole 16 within hours of drilling the borehole 16. For example, if a 300 foot long lateral borehole 16 is drilled, it is preferred to insert a liner into the 300 foot lateral borehole 16 using the end of the lateral tubular 40 right after drilling the 300 foot lateral borehole 16. Although it may be preferred in the prior art to drill the borehole, set the liner, cement the liner off, and then drill out the end of the liner in the lateral tubular, this takes much longer and poses a problem with unconsolidated formation which may cave into the lateral borehole 16 before the complete borehole is drilled and the liner installed. Once the 300 foot liner has been installed, then the remainder of the lateral borehole 16 can be drilled through the liner.

Figure 16:
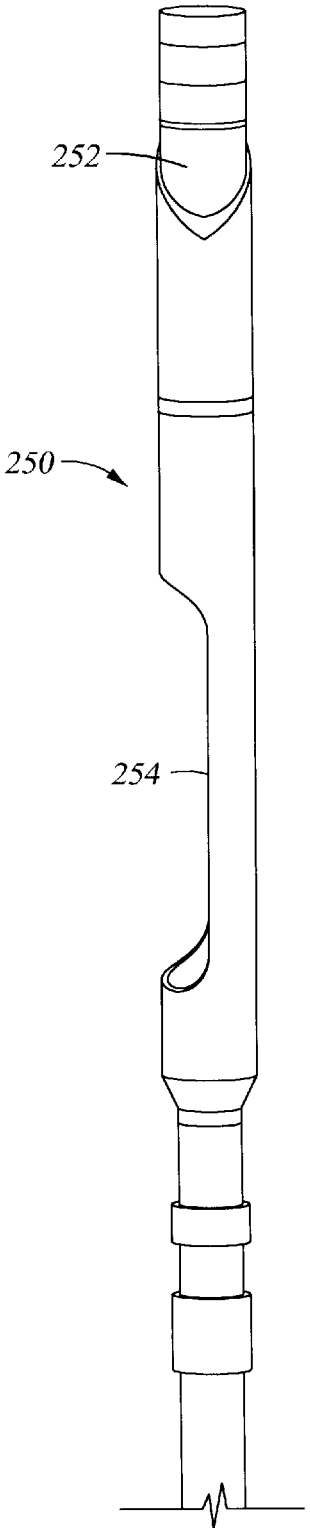
FIG. 16 is a side elevation view of an alternative lateral tubular without a main tubular.
Figure 17:
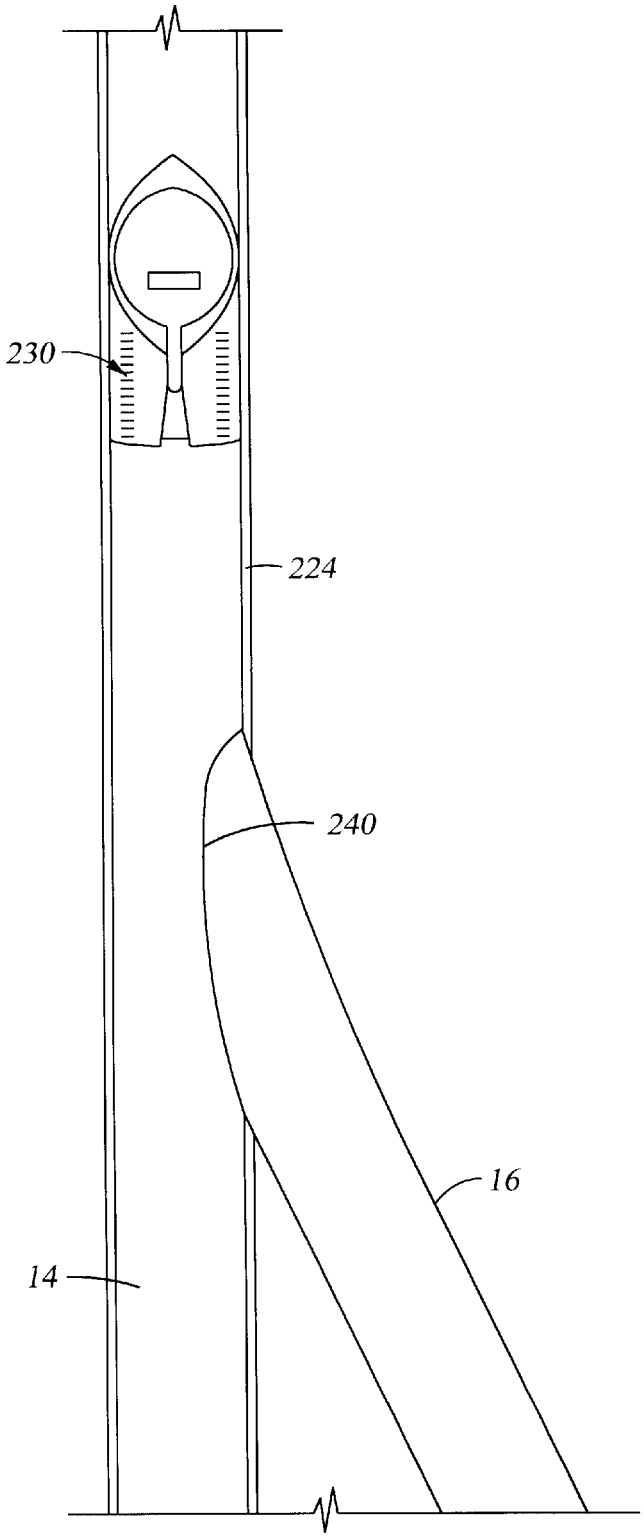
FIG. 17 is a side elevation view of a well reference member disposed in the main cased borehole above the lateral borehole.
Figure 18:
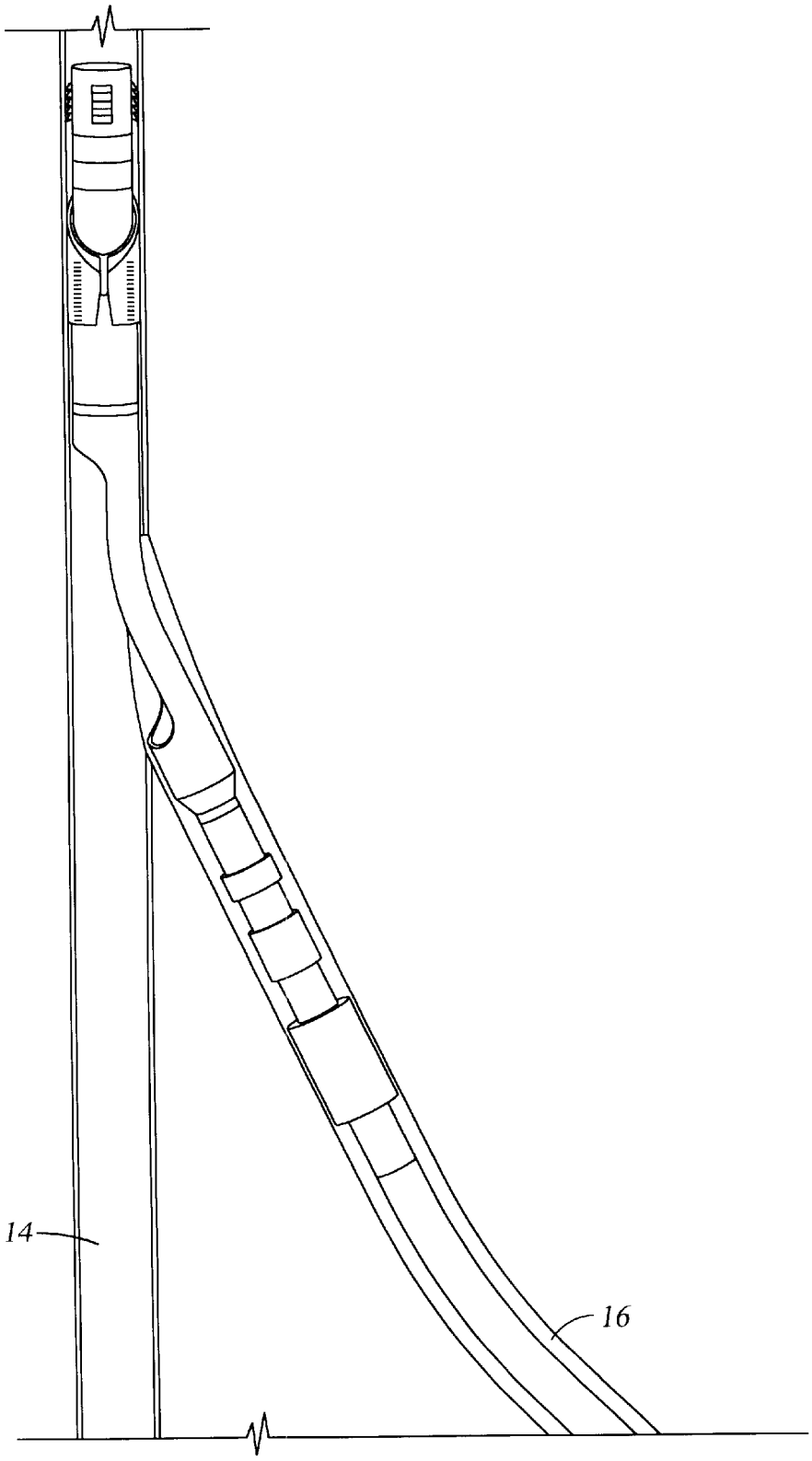
FIG. 18 is a side elevation view of the lateral tubular of FIG. 16 deployed in the lateral borehole of FIG. 17.

Referring now to FIGS. 16–18, in still another embodiment, a well reference member 230, like that shown in pending U.S. PCT application Ser. No. PCT/US01/16442, is disposed in the casing 224 of primary borehole 14 above the drilled lateral borehole 16. This embodiment is described in Great Britain Application No. U.K. 0112456.9, filed on May 22, 2001, and entitled "Downhole Lateral Completion System," hereby incorporated by reference. In this embodiment the well reference member 230 is located above the junction rather than below as in previous embodiments. Well reference member 230 is set after the lateral borehole 16 is drilled. As shown in FIGS. 16–17, well reference member 230 serves as the orienting member for the lateral tubular 250, similar to lateral tubular 40, which is lowered individually down the primary cased borehole 14 without a main tubular 20. As shown in FIG. 16, the lateral tubular 250 includes a mating orienting member 252, such as a mating mule shoe, which engages well reference member 230 for orienting the window 254 in lateral tubular 250 with the window 240 of the lateral borehole 16. A deflector may be set below the junction to guide the completion into the lateral borehole 16. As shown in FIG. 18, production through the main borehole 14 passes through the cased borehole below the junction since there is no main tubular.

In a further embodiment, the junction may be used in a new well where the operator knows that a lateral borehole 16 is to be drilled. The main tubular 20 may be run as part of a casing string. The ends of main tubular 20 have threaded connections so that it could be attached to a length of casing. In one example, the main tubular 20 is run as part of a 9⅝ inch string of casing whereby the inside diameter of top of the main tubular 20 may be 8½ inches, allowing a larger ramp out angle through window 26. Also larger sized tubulars may be run through main tubular 20. Window 26 in main tubular 20 is scabbed over by a sleeve which fits over the outside of main tubular 20 to protect and close off window 26. The sleeve may be a fiberglass sheath. The sleeve over window 26 permits the casing 224 to be cemented in the borehole 14 without the cement flowing through window 26 and into the inside diameter of main tubular 20.

Once the main tubular 20 has been cemented in place, the main tubular 20 is then cleaned and the sleeve milled out to expose the window 26 such that the lateral borehole 16 can be drilled through window 26. A deflector 150 may be lowered into the main tubular 20 to guide a tool to drill out the fiberglass sheath. The lateral tubular 40 may then subsequently be run down through main tubular 20 and ramped out into the newly drilled lateral borehole 16. This is basically a section of casing with a pre-milled window. Pre-milled windows are taught by the prior art, thus one with skill in the art can appreciate a pre-milled window scabbed over by a sheath. However, the prior art casings with pre-milled windows do not include ramps to guide an inner member out into the lateral borehole 16.

In this alternative embodiment, the window 26 must be oriented in the proper direction since it is more difficult to rotate and align a string of casing. Preferably there is also included a mule shoe profile in the main tubular 20 to properly orient the subsequent lateral tubular 40 so that it is deployed out into a subsequently produced lateral borehole. Thus, there may be a profile, either above or below window 26 to guide, land, and orient the lateral tubular 40 which is subsequently run into the well. In one embodiment, the profile is above the window, as was seen in the embodiment of FIGS. 16–18 on Great Britain Application No. U.K. 0112456.9. However, the profile may be disposed inside the main tubular 20 causing the flowbore of the casing string to be reduced.

The mule shoe may be part of the main tubular 20 if the alignment of the window 26 with the lateral borehole 16 is known. The well reference member 230 is used in the preferred embodiment to align the entire assembly. If a well reference member is also included in this embodiment, little advantage has been gained. However, several advantages do emerge in this embodiment. One advantage is that the window 26 has been pre-cut and will not have to be milled, thus the operator knows the exact profile of the window 26. When a window is milled into the casing, the edges of the window in the casing are jagged and unpredictable, and therefore hard to seal. Another advantage is that the mule shoe could also be pre-milled inside the main tubular in the casing string. The mule shoe is then set for depth and orientation. The throughbore may be slightly larger in the alternative embodiment than in the preferred embodiment, but not so much larger as to encourage including the main tubular 20 in the casing string rather than running it in later with the lateral tubular 40.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. An apparatus comprising:

a first tubular having a cylindrical portion with an aperture in one side thereof, said aperture forming opposing edges providing a ramp adjacent said aperture; and a second tubular being received within said cylindrical portion and having a first position with said first and second tubulars being coaxial and a second position with said second tubular being cammed out said aperture with one end of said second tubular projecting from said aperture.

2. The apparatus of claim 1 further including cooperative orientation surfaces on said first and second tubulars orienting said second tubular with respect to said first tubular upon said second tubular moving from said first position to said second position.

3. The apparatus of claim 1 further including a releasable connection connecting said first and second tubulars in said first position.

4. The apparatus of claim 3 wherein said releasable connection is a shear member extending through walls of said first and second tubulars.

5. The apparatus of claim 1 wherein said second member includes an opening in one side thereof, said opening being aligned with said aperture in said second position.

6. The apparatus of claim 5 wherein said aperture and opening form a common window between said first and second tubulars.

7. The apparatus of claim 1 wherein said first tubular further includes a guide surface to orient tools which pass through said first tubular.

8. The apparatus of claim 1 wherein said ramp includes an arcuate surface cut at an angle in said first tubular.

9. The apparatus of claim 8 wherein said ramp begins at an enlarged diameter portion of said first tubular and extends along rails formed in opposing walls of said first tubular.

10. The apparatus of claim 1 wherein said first tubular includes an inner diameter from one end of said first tubular to the beginning of said ramp and then a reduced inner diameter to another end of said first tubular.

11. A method of deploying a Y junction, the method comprising:

inserting one end of a second tubular into a cylindrical end of a first tubular, the cylindrical end having an aperture in one side thereof, said aperture forming opposing edges providing a guide surface adjacent the aperture;

further inserting the second tubular into the first tubular against the guide surface in the cylindrical end of the first tubular;

guiding the one end of the second tubular along the guide surface through the aperture; and extending the one end of the second tubular through the aperture with another end of the second tubular remaining in the first tubular to form a Y junction.

12. The method of claim 11 further including orienting the first tubular with respect to the second tubular as the first tubular moves through the second tubular.

13. A junction for the intersection of a primary borehole and a lateral borehole, the junction comprising:

a main tubular adapted for passing through the primary borehole having a cylindrical portion with a main window in one wall thereof, said main window forming opposing edges configured to provide a guide surface aligned with said main window; and a lateral tubular having one end received within said cylindrical portion of said main tubular and engaging said guide surface to guide said one end through said main window and adapted to extend into the lateral borehole.

14. The junction of claim 13 wherein said guide surface is a ramp in said main tubular directing said lateral tubular through said main window to dispose said lateral tubular within the lateral borehole.

15. The junction of claim 14 wherein said ramp is disposed along edges in said wall forming said main window.

16. The junction of claim 15 wherein said ramp comprises an arcuate surface cut at an angle in said main tubular.

17. The junction of claim 16 wherein said inner diameter of said main tubular has substantially the same radius as the outer diameter of said lateral tubular.

18. The junction of claim 13 wherein said main tubular further includes an orientation member disposed within said main tubular.

19. The junction of claim 18 wherein said deflector includes an orienting surface engaging said orientation member orienting said deflector with respect to said main window.

20. The junction of claim 19 wherein said deflector includes a latch to releasably connect said deflector to said main tubular.

21. The junction of claim 20 wherein said latch includes at least one collet finger adapted to engage said main tubular.

22. The junction of claim 13 wherein said one end of said lateral tubular disposed within said main tubular is releasably coupled to said main tubular.

23. The junction of claim 22 wherein a shear member releasably couples said main and lateral tubulars.

24. The junction of claim 13 wherein said lateral tubular further includes a guide.

25. The junction of claim 13 wherein said main and lateral tubulars each include orientation surfaces which engage to align said lateral tubular with said main tubular.

26. The junction of claim 13 further including cement around said main and lateral tubulars.

27. The junction of claim 13 further including conduits extending through said main and lateral tubulars with seals sealing said conduits with the primary borehole and with the lateral borehole.

28. The junction of claim 13 wherein said lateral tubular further includes a liner disposed on said one end of said lateral tubular.

29. The junction of claim 13 wherein said lateral tubular includes a lateral window adapted to be aligned with said main window.

30. The junction of claim 29 wherein said main and lateral tubulars include orientation surfaces which engage to align said lateral and main windows.

31. The junction of claim 13 further comprising an orientation member disposed within said main tubular below said lateral tubular.

32. The junction of claim 31 further including a deflector received within said main tubular.

33. The junction of claim 32 wherein said deflector includes an orientated surface adapted to guide tools through said lateral tubular.

34. The junction of claim 22 wherein said deflector includes a bore therethrough.

35. The junction of claim 32 wherein a sealing assembly is coupled to one end of said deflector.

36. A multilateral well completion method at the intersection of a main bore and a lateral bore, the method comprising:

releasably attaching coaxially a main tubular to a lateral tubular;

running the tubulars into the main bore;

landing the main tubular within the main bore;

preventing further downhole movement of the main tubular;

aligning a main window in the main tubular with the lateral bore;

telescopically moving the lateral tubular with respect to the main tubular;

engaging an end of the lateral tubular with a guide surface formed from the main window of the main tubular; and guiding the end of the lateral tubular out through the main window and into the lateral borehole.

37. The method of claim 36 further including:

orienting the lateral tubular with the main tubular orientation member; and aligning a lateral window in the lateral tubular with the main window.

* * * * *